US007316876B2

(12) United States Patent
Kobayashi

(10) Patent No.: US 7,316,876 B2
(45) **Date of Patent: *Jan. 8, 2008**

(54) ELECTROPHOTOGRAPHIC PHOTORECEPTOR AND A MANUFACTURING METHOD THEREOF

(75) Inventor: Nobuaki Kobayashi, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 340 days.

This patent is subject to a terminal disclaimer.

(21) Appl. No.: 10/862,306

(22) Filed: Jun. 7, 2004

(65) Prior Publication Data

US 2005/0271959 A1 Dec. 8, 2005

(51) Int. Cl.
*G03G 5/14* (2006.01)
*G03G 5/04* (2006.01)
*G03G 15/14* (2006.01)

(52) U.S. Cl. ..... 430/60; 430/56; 430/132; 430/133; 430/125.3; 430/123.4

(58) Field of Classification Search ..... 430/56, 430/60, 126, 133, 132, 123.4, 125.3; 399/159
See application file for complete search history.

(56) References Cited

U.S. PATENT DOCUMENTS

2003/0190547 A1* 10/2003 Kobayashi et al. ..... 430/125

FOREIGN PATENT DOCUMENTS

| | | |
|---|---|---|
| JP | 60-097361 | 5/1985 |
| JP | 01-123243 | 5/1989 |
| JP | 01-321435 | 12/1989 |
| JP | 02-157847 | 6/1990 |
| JP | 03-050551 | 3/1991 |
| JP | 05-142789 | 6/1993 |
| JP | 8-179521 | 7/1996 |
| JP | 08314159 A * | 11/1996 |
| JP | 09-160268 | 6/1997 |
| JP | 09-281725 | 10/1997 |
| JP | 11-160893 | 6/1999 |
| JP | 11-194509 | 7/1999 |
| JP | 11-327173 | 11/1999 |
| JP | 2000-304244 | 11/2000 |
| JP | 2000-347427 | 12/2000 |

OTHER PUBLICATIONS

Borsenberger, Paul M. et al. Organic Photoreceptors for Imaging Systems. New York: Marcel-Dekker, Inc. (1993) pp. 6-9 & 289-292.*

* cited by examiner

*Primary Examiner*—Christopher RoDee
(74) *Attorney, Agent, or Firm*—Lucas & Mercanti, LLP

(57) ABSTRACT

Disclosed is an electrophotographic photoreceptor which comprises a layer on a support, wherein the photoreceptor satisfies a condition represented by Formulas 1 and 2;

$0<P_{max}<2P$ Formula 1

$2\leqq(P_{max}/D)\times100\leqq50$ Formula 2 wherein P represents an average of the layer thickness in μm at the central position in the width direction of image forming area of the support, $P_{max}$ represents is an average of the largest value of the layer thickness in μm without the image forming area, D represents an average of the distance in μm from the point where the largest value is formed to the edge of the layer and a image forming method and an apparatus using the same.

13 Claims, 9 Drawing Sheets

FIG. 2
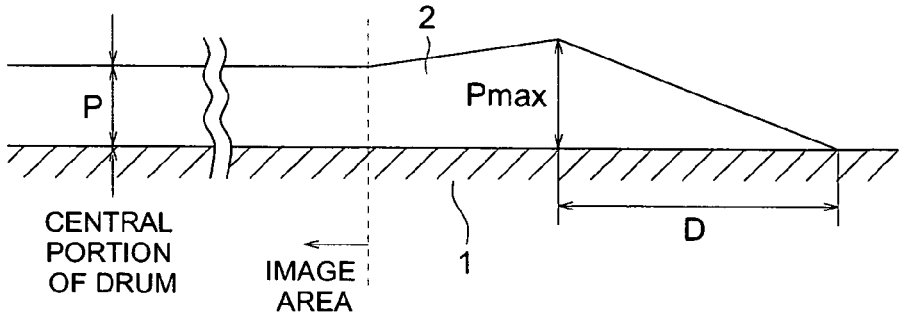
FIG. 3 ( a )
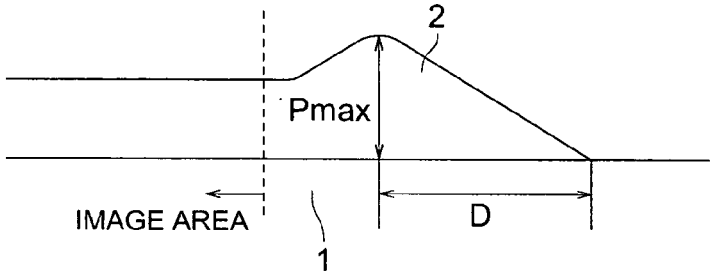
FIG. 3 ( b )
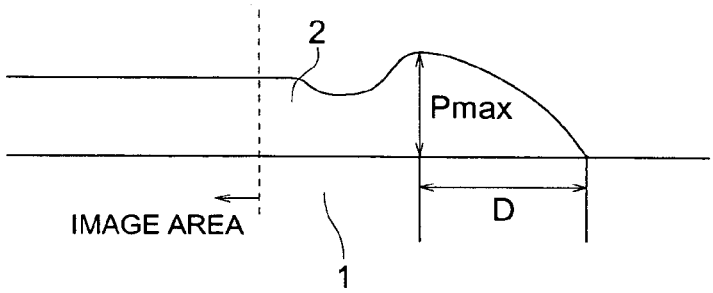
FIG. 3 ( c )
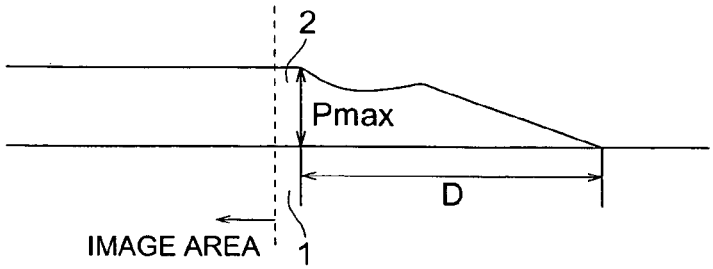

FIG. 10 ( a )
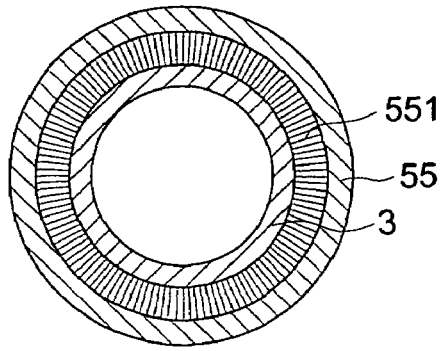
FIG. 10 ( b )
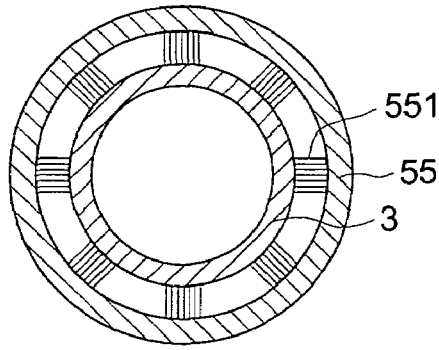
FIG. 10 ( c )
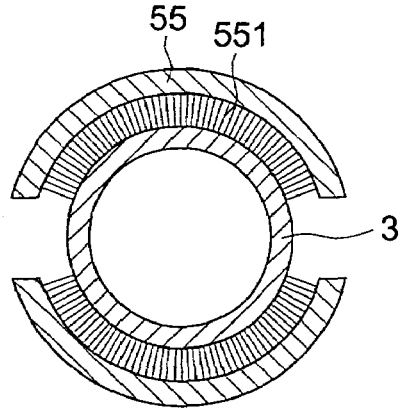

ELECTROPHOTOGRAPHIC PHOTORECEPTOR AND A MANUFACTURING METHOD THEREOF

BACKGROUND

1. Technical Field

The present invention relates to an electrophotographic photoreceptor, occasionally referred to as a photoreceptor, to be used in an electrophotographic image forming apparatus such as a copying machine, a laser beam printer and a facsimile machine, and a manufacturing method thereof, and in more detailed, relates to removal of coated layer adhered to an unnecessary area of the photoreceptor.

2. Related Art

The electrophotographic photoreceptor is usually manufactured by immersing a cylindrical electroconductive support into a coating liquid such as a photosensitive layer coating liquid, an intermediate layer coating liquid and a surface protective layer coating liquid to form a coating layer. In such the case, the coating layer is entirely formed on the surface of the cylindrical electroconductive support since the support is immersed in the coating liquid. When the photoreceptor drum entirely coated with the layer is installed in an electrophotographic apparatus, the coated layer is occasionally peeled off by contacting to parts such as a roller to be touched to a developing device, and the photoreceptor drum cannot be utilized as the contacting point for grounding. Consequently, it is preferable to remove the coated layer adhered at the both end portions of the photoreceptor drum.

As the method for removing the coated layer, methods have been known such as the method of that the end area of the photoreceptor drum is immersed in an solvent and vibrated by ultrasonic wave described in Japanese Patent Publication Open to Public Inspection, hereinafter referred to as Japanese Patent O.P.I. Publication, No. 63-311357, the method of that the coated layer is scoured off by a brush described in Japanese Patent O.P.I. Publication Nos. 3-60782, 4-141663, 5-142789, 10-207084, 11-184100 and 11-194509, and the method employing a tape. The following methods have been known, for example, the method of that a tape composed of heat-bonded type nonwoven fabric is successively let out and then a solvent is supplied to the tape, and the tape is contacted to the photoreceptor drum to remove the photosensitive layer described in Japanese Patent O.P.I. Publication No. 4-65376, the method of that a tape impregnated with a solvent is let out and the tape is contacted to the photoreceptor drum to remove the coated layer, and the method using a nonwoven fabric having uneven surface on one side described in Japanese Patent O.P.I. Publication No. 9-281725.

In any method, however, problems occur such as that the coated layer near the end portion of the photoreceptor where the coated layer is removed tends to be peeled off, and the toner is accumulated at the end portion of the photoreceptor so as to cause insufficient cleaning and contamination of interior of the apparatus by the toner. As a result of that the durability of the photoreceptor drum and the cleaning member is extremely degraded. Consequently, it is demanded that the shape of the coated layer is developed which does not cause such the problems.

SUMMARY

First aspect of the invention is an electrophotographic photoreceptor comprising a layer on a support, wherein the photoreceptor satisfies a condition represented by Formulas 1 and 2;

$$P<P_{max}<2P \quad \text{Formula 1}$$

$$2\leqq(P_{max}/D)\times100\leqq50 \quad \text{Formula 2}$$

wherein P represents an average of the layer thickness in μm at the central portion in the width direction of image forming area of the support, $P_{max}$ represents is an average of the largest value of the layer thickness in μm without the image forming area, D represents an average of the distance in μm from the point where the largest value is formed to the edge of the layer.

Second aspect of the invention comprises a method for manufacturing the electrophotographic photoreceptor as defined above comprising;

forming the layer on the support, and removing the edge of the layer by a scouring member.

Third and fourth aspects of the invention are an image forming method and image forming apparatus employing the above-described photoreceptor.

BRIEF DESCRIPTION OF THE DRAWINGS

The present invention will become more fully understood from the detailed description given herein below and the accompanying drawings which are given by way of illustration only, and thus are not intended as a definition of the limits of the present invention, and wherein:

FIG. 2 is a schematic enlarged cross section of the edge portion of the coated layer.

FIGS. 3(*a*) to 3(*c*) each is a schematic drawing of the microscopic cross section of the portion where the photosensitive layer is removed by scouring.

FIGS. 10(*a*) to 10(*c*) each is displays an embodiment of the scouring member.

DETAIL DESCRIPTION

The invention is described below. The invention, however, is not limited to the description; and it is not intended to exclude any obvious substitution or replacement.

Figure 1:
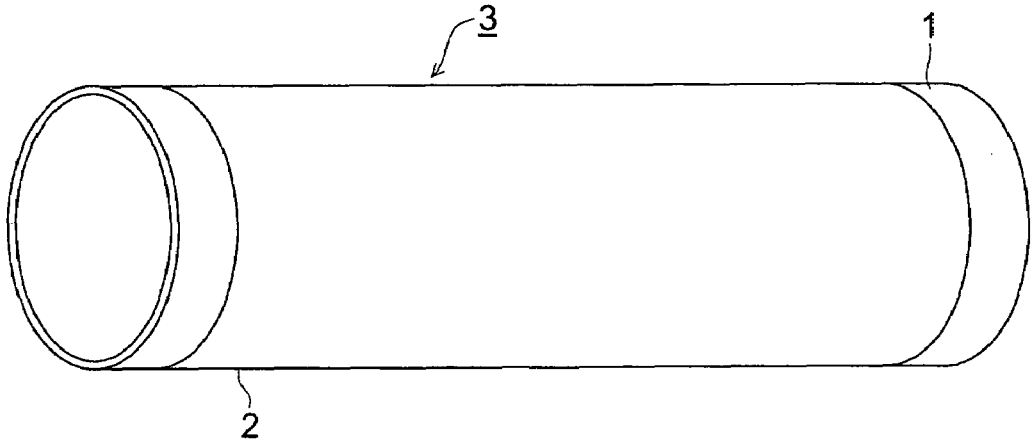
FIGS. 1(*a*) to 1(*c*) each is a drawing describing the electrophotographic photoreceptor drum and the defined value utilizing in the invention.
Figure 1:
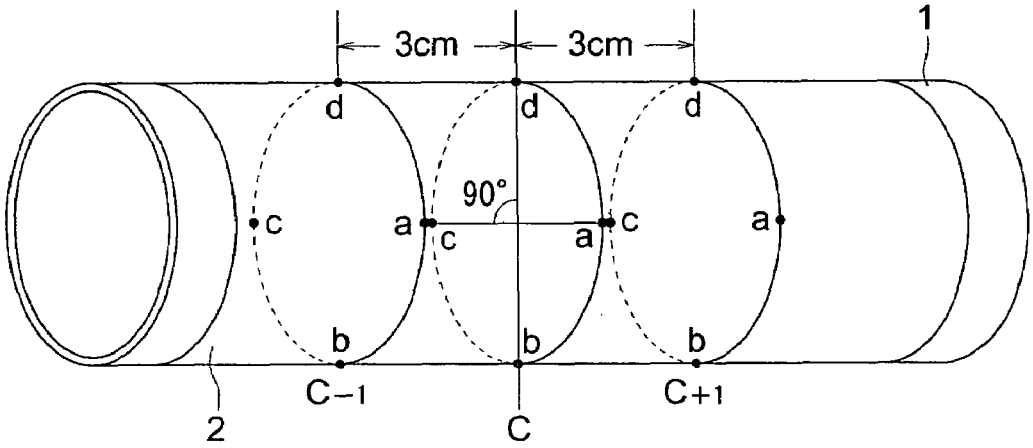
Figure 1:
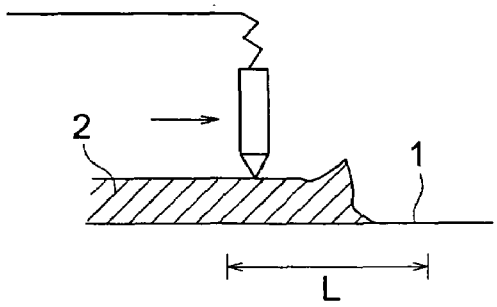
Figure 4:
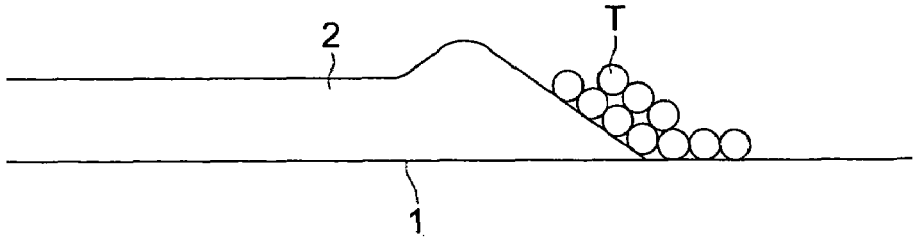
FIG. 4 is a conceptual cross section showing the situation of adhesion of the accumulated toner or the coagulated toner.

The electrophotographic photoreceptor and the defined value utilized in the invention are described referring FIG. 1.

Herein, the coated layer contains the entire layers coated on the support according to necessity such as a photosensitive layer including a charge generation layer and a charge transfer layer of a function separated type photoreceptor, an intermediate layer and a surface protective layer.

The electrophotographic photoreceptor drum 3 has the shape as displayed by the cross section of FIG. 1(*a*), and is constituted by an electroconductive support 1 on the surface of which the photosensitive layer, and the intermediate layer and the surface protective layer are coated according to necessity. It is desirable that the both edge portions of the coated layer on the photoreceptor drum are completely removed, and the shape of the edge is also important.

The measuring method of the average value P (μm) of the layer thickness at the central portion of the photosensitive layer utilizing to the definition of the invention is described below.

The average value P of the layer thickness at the central portion of the photosensitive layer is described referring FIG. 1(*b*). The layer thickness is measured at four positions each making a right angle on each of the cross sections at the center C and the positions $C_{-1}$ and $C_{+1}$ each apart 3 cm from C, namely Ca, Cb, Cc, Cd, $C_{+1}$a, $C_{+1}$b, $C_{+1}$c, $C_{+1}$d, $C_{-1}$a, $C_{-1}$b, $C_{-1}$c and $C_{-1}$d. The average of the layer thicknesses at the above twelve points is defined as P. A swirl electric current type layer thickness measuring apparatus EDDY560C, manufactured by Helmut Fischer GMBTE Co., Ltd., is used for measuring the layer thickness. Another measuring apparatus, however, may be used as long as the measuring principle is the same as that.

The layer thickness at the edge portion of coated layer is measured as follows by a continuous layer thickness measuring method.

The layer thickness is continuously measured by scanning at one edge of the photosensitive layer as displayed in FIG. 1(*c*). The measuring length L, including two parts of the coated layer containing the image forming area and a part of the electroconductive support, is, for example, approximately 5 mm even though which may be different depending on the length of the electroconductive support.

The measurement is carried out at four positions each making a right angle on the cross section of the cylindrical electroconductive support the same as in FIG. 1(*b*), and the measured data are average to obtain an average profile as shown in FIG. 2. $P_{max}$ and D are calculated from the average profile. Moreover, the measurement and calculation are performed with respect to the other edge of the drum. It is preferable that each of the values at both edge of the drum satisfies the definition of the invention.

The measurement is performed by a layer thickness measuring apparatus Surfcom, manufactured by Kosaka Kenkyusho, in the cross section curve mode. The surface layer measuring apparatus Surfcom is used for measurement, but another measuring apparatus may be used as long as the measuring principle is the same as that.

It is not easy practically to provide the coated layer on the surface of the electroconductive support and to completely remove the layer at the both edges thereof so as to expose the surface of the electroconductive support. At the present time, methods for removing the layer by scouring employing a brush or tape impregnated by a solvent have been developed. It is found, however, that a problem rises in such the methods even though they are superior methods.

The edge portion of the coated layer has the shape as shown in the enlarged schematic cross section of FIG. 2 even when the coated layer is removed by scouring by the above methods.

In FIG. 2, the coated layer 2 including the photosensitive layer is coated on the surface of the electroconductive support 1; the $P_{max}$ is the average of the largest thickness of the layer at the out side of the image forming area, occasionally referred to as the image area, and the P is the average layer thickness at the central portion of the drum. The D is the average distance from the position of the $P_{max}$ to the exposed area of the surface of the electroconductive support where the coated layer is completely removed. The unit of the above values is expressed by μm.

As is displayed in FIG. 2, the thickness of the photosensitive layer at the central portion of the drum microscopically shows stable value and has a certain prescribed thickness within the range of from 15 to 50 μm. The thickness is become instable near the removed portion at the edge of the drum by the scouring, and the layer is raised a little to become thick and then gradually thinned as shown in the drawing.

The shape of the layer at the portion removed by the scouring includes various shapes such as the microscopic cross section displayed as reference in FIG. 3. The shape in FIG. 3(*a*) is similar to that described in FIG. 2; the shape in FIG. 3(*b*), the layer thickness is once lowered than the constant thickness between the constant thickness area and the position of $P_{max}$ and is arrived at $P_{max}$ thicker than P ($P_{max}$>P), and then gradually thinned; and in the shape in FIG. 3(*c*), there is no portion thicker than P at the edge of the photosensitive layer and the thickness is gradually reduced and finally the surface of the electroconductive support is exposed even though the layer thickness is reduced in a constant rate.

It is not cleared yet that what conditions cause such the various shapes. It has been found that the excessively large variation of the layer thickness or the shape at the edge of the layer causes a problem. Because, accumulation of the toner or the adhesion of coagulated toner particles occurs at such the portion during a prolonged period of use and the peeling off of the coated layer occurs from such the portion, which are cause various troubles. Namely, the adhesion of the toner T is seen at the edge portion of the coated layer 2, and it is found that the adhesion is easily caused when the value of $P_{max}$ is larger and the value of $P_{max}$/D is larger.

Figure 5:
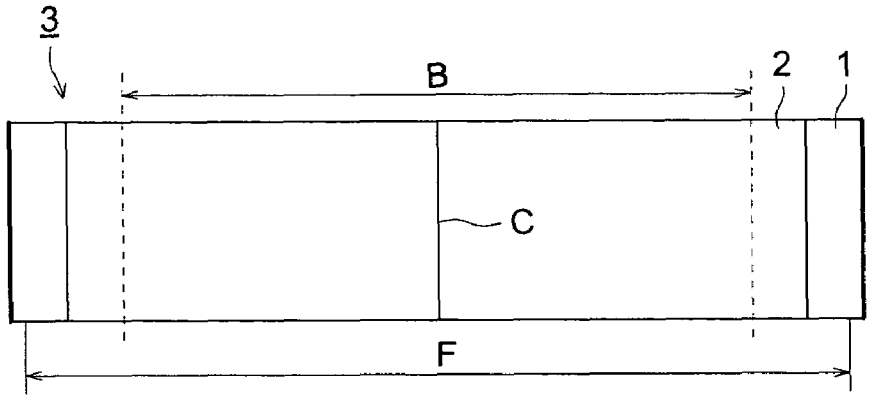
FIG. 5 is a drawing displaying the cleaning area of the photoreceptor drum.

The reason of the above can be easily understood by considering the cleaning range displayed in FIG. 5. In the photoreceptor drum, the coating layer 2 is coated on the electroconductive support 1, and in the coated layer, the area to be used for image formation (image forming area) B is the range directly touching or facing to the magnetic brush of the developing device. The area to be subjected to the cleaning is the area F touched with a cleaning member which is a cleaning blade in many cases. The area B is within the area where the effect of the layer thickness variation is not appeared, and the area F includes the area where the photosensitive layer is not completely removed. The photosensitive layer on the photoreceptor drum is wider than the area B and narrower than the area F. Therefore, the layer is coated until a position between the area B and the area F. As above-described, the edge of the coated layer is influenced by the removing of the photosensitive layer so that the thickness of the layer is locally varied and instable. The adhered amount of the toner is increased accompanied with increasing of the local variation of the layer thickness; and the layer at such the portion tends to be peeled off by the stress caused by the cleaning blade. Thus, problems tend to occur. C is the central portion of the electrophotographic photoreceptor drum.

Usually, $P_{max}$ is from 10 to 60 μm, and P is from 15 to 35 μm. The value of $(P_{max}/D)\times100$ is preferably made to from 2 to 50%. When $P_{max}$ is 60 μm or less, the layer is difficultly peeled and the image defect is difficultly caused since the peeled powder is difficultly adhered to the image area. The coated layer is easily removed when $(P_{max}/D)\times100$ is set at a value not less than 2%; that is advantageous for the production. When $(P_{max}/D)\times100$ is not more than 50%, the toner contamination is low and the adhesiveness at the edge portion is improved.

However, the method possible to stably remove the coated layer on the photoreceptor drum so as to be within the above range is the method by the tape and that by the brush, even though there is no specific limitation on the coated layer removing method for satisfying the above condition. The methods are described below.

As the means for controlling the state of the edge so as to be within the above range, the material of tape, the touching condition of tape, the edge shape of tape, the material of brush, the composition of solvent, the time for scouring and the swelling state of coated layer before removing are utilizable. Among them, the controlling by the swelling state of coated layer before removing, the touching condition of tape, the material of brush and the selection of the kind of solvent are relatively easily applied.

Examples of the solvent usable for removing the edge portion of the coated layer include an ether, an alcohol, a chlorinated solvent and a ketone such as tetrahydrofuran, methanol, chloroform, methylene chloride, methyl ethyl ketone (MEK) and acetone and a mixture thereof.

The embodiment of the removing method is described below referring the drawings

1. Removing Method by the Wiping Tape

Figure 6:
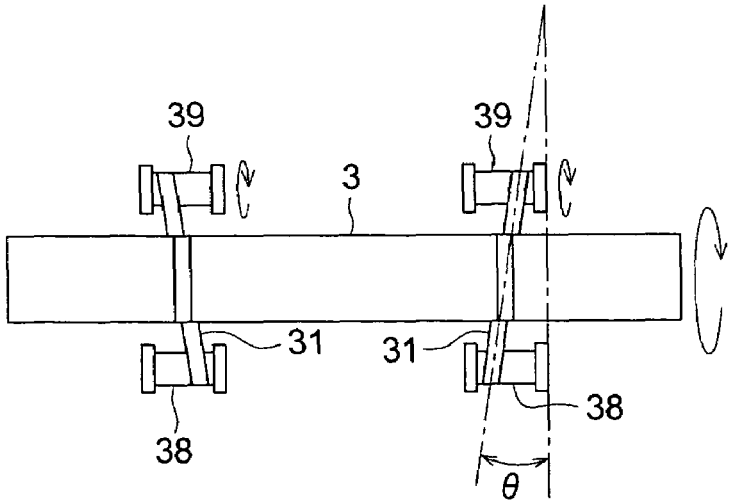
FIG. 6 is a schematic drawing displaying the scouring tape set to the photoreceptor drum with a tilt.

FIG. 6 displays the scheme of the wiping tape set at the photoreceptor drum for making an angle θ larger than 0°. In FIG. 6, 31 is the wiping tape, 3 is the photoreceptor drum, 38 is a let out roll, 39 is a take up roll and θ is the tilt angle. The arrow indicates the rotating direction.

The edge of the coated layer can be made smooth without formation of burrs by touching the wiping tape to the edge portion of the photoreceptor drum so that the running direction of the tape is tilted to make an angle θ larger than 0° with the surface perpendicular to the length direction of the photoreceptor drum as shown in FIG. 6 since the contacting points of the wiping tape to the section of the coated layer is reduced and the dissolved coated layer can be wiped off so that the dissolved composition is not solidified. The preferable tilting angle of the tape is more than 0° and less than 40°. The possibility of the occurrence of the layer peeling from the edge portion and that of damage on the edge portion of the cleaning blade can be reduced by smoothing the edge of the coating layer.

<Wiping Tape>

As the material of the wiping tape, one capable of being impregnated by the solvent to be employed is preferably usable. The material can be employed without any limitation as long as the material is not corroded by the solvent to be employed and endurable to the tension on the occasion of wiping. Examples of the usable material include a synthesized fiber, for example, a polyamide fiber such as Nylon 6 fiber and Nylon 66 fiber, a polyester fiber such as poly (ethylene terephthalate) fiber and poly(butylene terephthalate) fiber, acryl fiber, vinylon fiber, vinylidene fiber, polyurethane fiber, fluorinated fiber, aromatic polyamide fiber, an olefin fiber such as polyethylene fiber and polypropylene fibbed; a reproduced cellulose such as rayon; a semi-synthesized fiber such as acetate fiber, an inorganic fiber such as carbon fiber, a vegetable fiber such as cotton fiber and linen fiber, and an animal fiber such as wool fiber.

<Impregnating Solvent>

As the impregnating solvent to be impregnated into the wiping tape, the foregoing ones can be employed without any limitation even though it may be varied according to the kind of the coating layer as long as the solvent can be removed the coated layer by dissolving or swelling.

The wiping is performed by a method touching of the wiping tape impregnated with the solvent capable of dissolving or swelling the coated layer to the rotating photoreceptor drum to wipe off the coated layer.

Although the moving direction of the wiping tape is not particularly limited, the direction reverse to the rotation direction of the photoreceptor drum is preferred since the coated layer can be wiped-off for shorter time.

Figure 7:
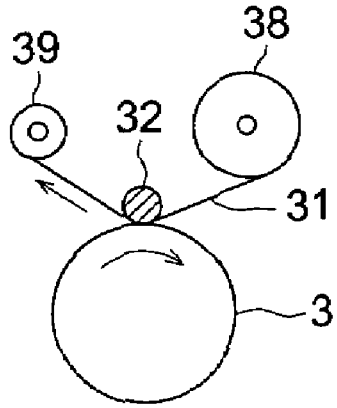
FIGS. 7(*a*) to 7(*c*) each is a schematic drawing displaying an example of the method for contacting the scouring tape to the photoreceptor drum.
Figure 7:
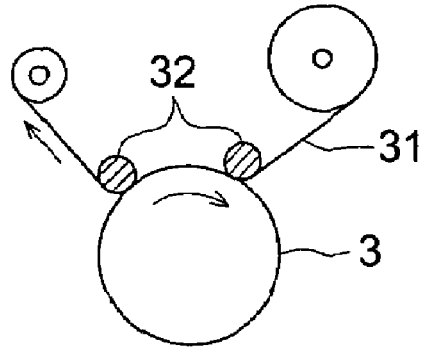
Figure 7:
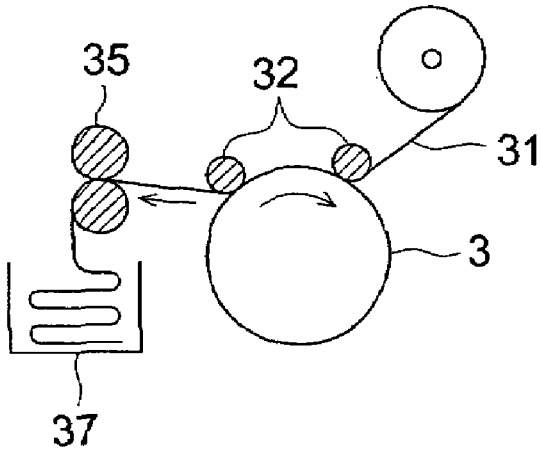

FIG. 7 is a schematic drawing displaying an example of the method for touching the wiping tape to the photoreceptor drum.

The concrete method for touching the wiping tape to the edge of the coated layer on the photoreceptor drum includes those displayed in FIGS. 7(*a*), 7(*b*) and 7(*c*).

FIG. 7(*a*) shows a method in which tension is applied to the wiping tape 31 between the let out roll 38 and the take up roll 39 and the tape is contacted by pressure to the photoreceptor drum by a pressing roller 32. For making the tilt angle of the running direction of the wiping tape to the angle θ larger than 0°, the angle can be optionally set by relatively staggering the position of the let out roll and that of the position of the take up roll as shown in FIG. 6.

FIG. 7(*b*) displays a method in which the wiping tape is contacted to the photoreceptor drum 31 by two pressure rollers 32.

FIG. 7(*c*) displays a method in which the take up roll 39 in FIG. 7(*a*) is replaced by a nip-driving roller 35 and the wiping tape after the wiping is recovered into a recovering container 37. The wiping tape after the wiping contains the solvent. Therefore it is preferable that the tape 31 is recovered into the container 37 since the possibility of the evaporation of the solvent in the room can be inhibited.

2. Removing by the Brush

Figure 8:
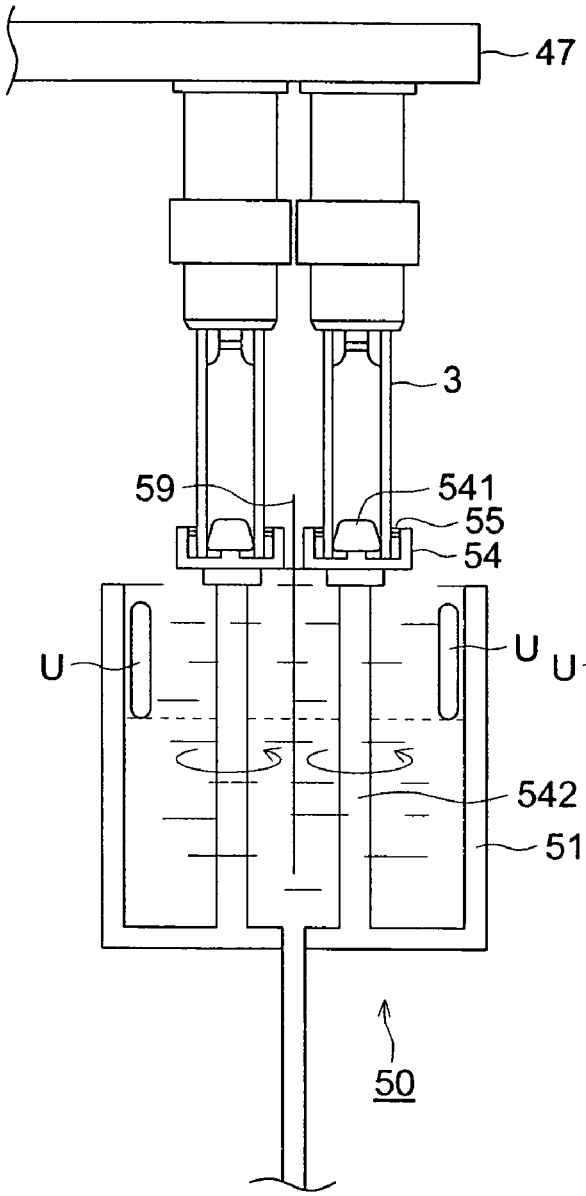
FIGS. 8(*a*) and 8(*b*) each is a cross section of a coated layer removing apparatus by a brush.
Figure 8:
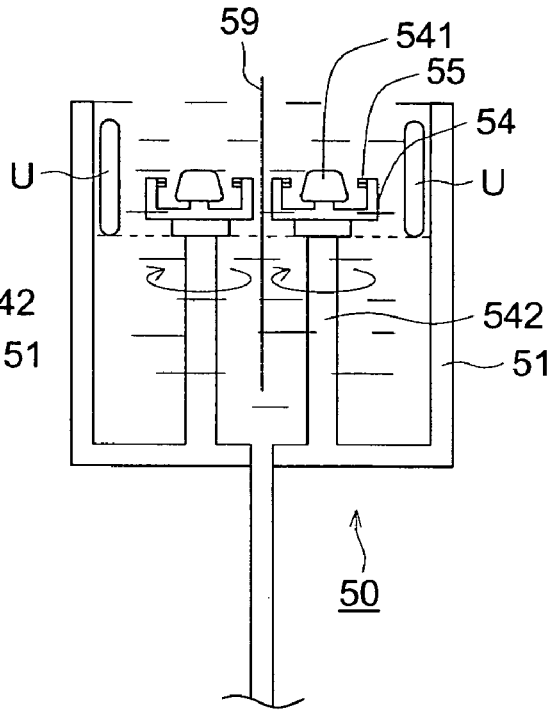

FIG. 8 is the cross section of the coating layer removing apparatus by the brush. In the drawing, 3 is the photoreceptor drum, on the surface thereof the coated layer is formed. The photoreceptor drum is held movably in up and down direction by a conveying means 47 and touched to a scouring member 55 provided to a coated layer removing stand (a coating layer removing means) 54 of the coated layer removing apparatus 50. A support holding member 541 of sponge is provided on the coated layer removing stand 54, and the support 3 is held by the support holding member and the scouring member. The support holding stand 54 is designed so that the stand can be rotated by a driving motor. The photoreceptor drum 3 is stood on the coating layer removing stand 54 by the conveying means 47 having a holding means such as an O-ring chuck and an air picker chuck for holding the interior of the support, and the lower end of the photoreceptor drum 3 is touched to the scouring member 55, cf. FIG. 8. On this occasion, the coated layer removing stand 54 is outside of the liquid surface of a solvent tank 51 as the washing means. The coated layer removing stand 54 is rotated when the remaining solvent in the coated layer at the edge portion of the photoreceptor drum is become to not more than 60%, and the coated layer at the lower end portion of the drum is wiped off by the scouring member 55 accompanied with the rotation of the stand. The remaining amount of the solvent is preferably from 3 to 60% by weight. The remaining solvent amount is percent by weight of the solvent remaining in the coated layer when the solvent amount in the coated layer just after the formation of the layer is defied as 100%, when plural layers are coated, the solvent amount just after the formation of the last layer is defined as 100%.

After finish of the wiping, the photoreceptor drum is lifted up by the conveying means 47, which is also functioned as a separating means, so as to be separated from the coated layer removing stand 54. Thereafter, the coated layer removing stand 54 is immersed into the solvent in the solvent tank 51, as is shown in FIG. 8(*b*), by the rotation of a cylinder 542 as a means for moving the coated layer removing means by which the up and down motion of the coated layer removing stand is made possible. The coated layer removing stand including the scouring means is entirely washed in the solvent tank by the combination of an ultrasonic cleaner and the up and down motion and the rotating motion of the coating layer removing stand. After that, the coated layer removing stand is lifted again to above the liquid surface of the solvent tank 51 by the rotation of the cylinder 542 to prepare the next removing operation of the coated layer. It is preferable that an ultrasonic vibrating element U is provided in the solvent tank to enhance the cleaning effect of the coated layer removing means. When remove of the coated layers of two or more drums are simultaneously carried out, it is preferable that a partition 59 is provided between each the coated layer removing means as is shown in FIG. 8 to prevent formation of defects caused by splashing of the liquid during the coated layer removing treatment of the each photoreceptor drums.

As the materials of the scouring member, a brush, sponge, cloth and polymer fiber cloth are usable, and the brush is preferred. Nylon, polyethylene, polypropylene, and polyester are suitable as the material of the brush. The size of a hole for providing the fiber of the brush is approximately from 0.5 to 2 mm, and the interval of the holes is approximately from 1 to 3 mm. The entire width of the brush is preferably decided corresponding to the width of the coated layer to be removed.

In the invention, the scoring member impregnating the solvent may be one carrying the solvent if it is not impregnated by the solvent. The impregnating amount of the solvent in the scouring member is preferably that the weight of the scouring member impregnate by the solvent is from 105 to 200 parts by weight when the weight of the dried scouring member is defined as 100 parts.

Figure 9:
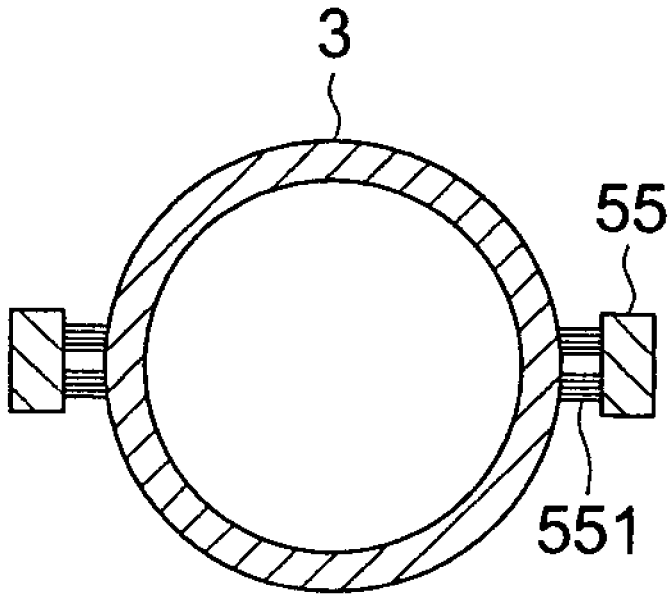
FIG. 9 is a cross section displaying the contacting status of the scouring tape to the photoreceptor drum.

FIG. 9 is a cross section displaying the contacting situation of the scouring member to the photoreceptor drum 3. The photoreceptor drum 3 is contacted to the brush 551 of the scouring member.

Figure 11:
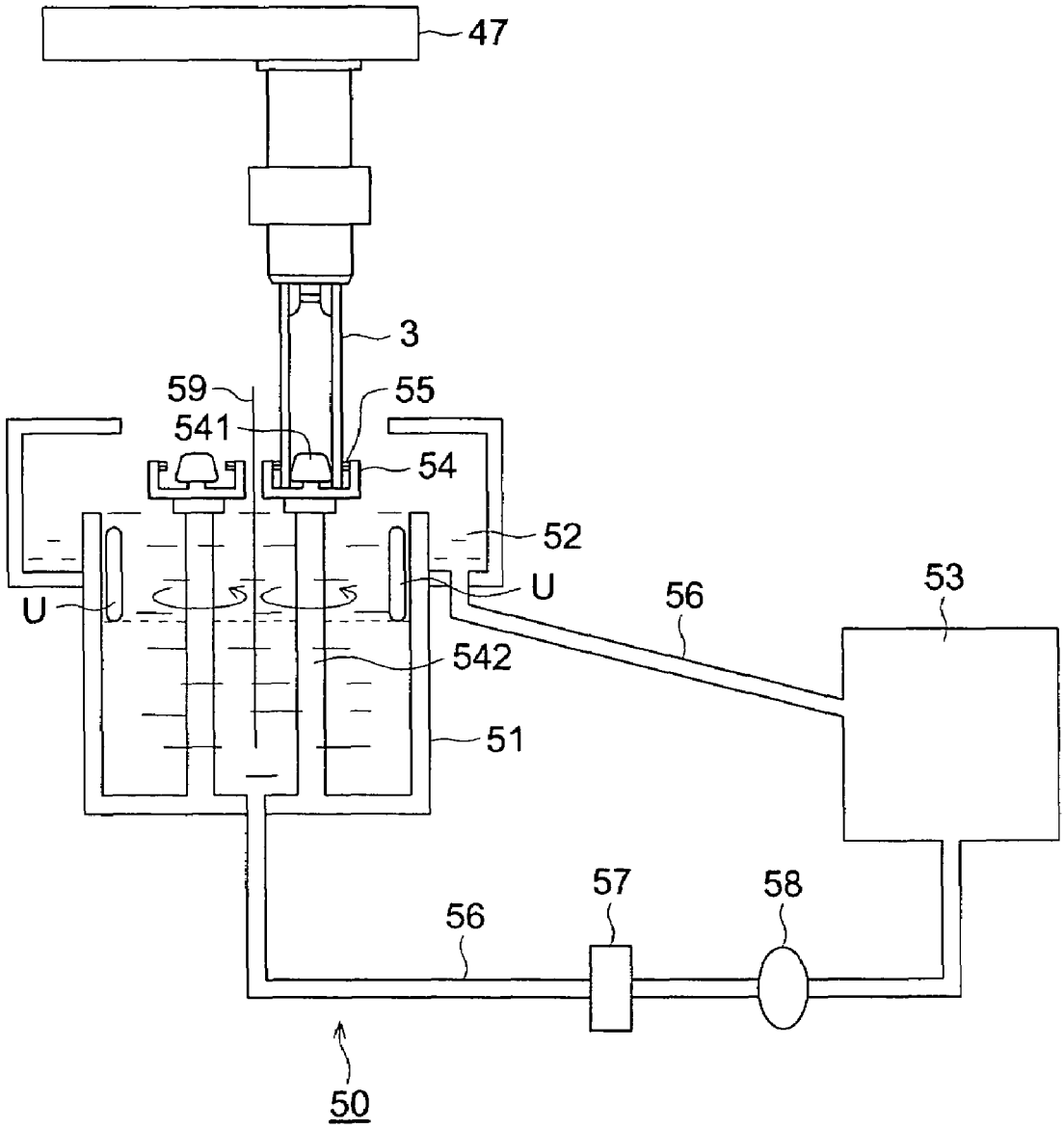
FIG. 11 is entirely constitution schema of an example of the coated layer removing apparatus.

FIGS. 10(*a*) to 10(*c*) each display a form of the scouring member 55. FIG. 11 is the entire construction drawing of the coated layer removing apparatus.

The coated layer removing apparatus 55 is constituted by the solvent tank 51, an overflowed solvent recovering chamber 52, a supplying tank 53, the coated layer removing chamber 54, the scoring member 55, a solvent circulation pipe 56, a pump 57, a filter 58 and the conveying means 47.

The scouring member 55 and a support holding member 541 are attached to the coated layer removing stand 54, and the scouring member is rotated accompanied with rotation of the coated layer removing stand 54 at the same time of the fixation of the support (a) so as to wipe off the coated layer at the lower end of the photoreceptor. As is shown in FIG. 11, the coated layer removing stand 54 is designed so that the coated layer removing stand is movable from or into the solvent tank 51 together with the scouring member 55 by the rotation of the cylinder 542.

The solvent in the solvent tank is usually circulated through the circulation pipe 56 and the components of the coated layer is removed by a filter provided at the half way of the circulations pipe so that the coated layer removing means can be sufficiently washed.

U in FIGS. 8(*a*), 8(*b*) and 11 is the ultrasonic generation device.

Next, the photoreceptor is described below.

Support (Substrate)

As the substrate of the photoreceptor, a cylindrical electroconductive support is employed. The cylindrical electroconductive support is a cylindrical support capable of endlessly forming an image by rotating; and the electroconductive support having a straightness of not more than 0.1 mm and a deviation of not more than 0.1 mm is preferred. When the straightness and the deviation exceed the above range, a fine image is difficultly obtained.

As the electroconductive material support, a drum of metal such as aluminum and nickel, a plastic drum evaporated with aluminum, tin oxide or indium oxide, and a paper or plastic drum each coated by an electroconductive substance are usable. The electroconductive support having a specific resistance of not more than $10^3$ Ωcm is preferable.

An endless belt can be used as the substrate. As the material of such the substrate, known materials such as polyamide, polyester and an electroformed nickel film are usable. An electroconductive layer is provided when the endless belt is an insulator.

Intermediate Layer

In the photoreceptor, the intermediate layer is provided between the support and the photosensitive layer to improve the adhesiveness between the support and the photosensitive layer and to prevent the injection of electron from the support. As the material of the intermediate layer, polyamide resin, vinyl chloride resin, vinyl acetate resin, and copolymer resin containing at least two kinds of the repeating unit of the above-mentioned resins are usable. Among the above resins, polyamide resin is preferred since increasing of the remaining potential accompanied with repeating use of the photoreceptor can be reduced. The thickness of the intermediate layer employing such the resins is preferably from 0.01 to 2.0 μm.

Preferable intermediate layer includes one employing a hardenable metal resin which is prepared by thermally hardening an organic metal compound such as a silane coupling agent and a titanium coupling agent. The thickness of the intermediate layer employing the hardenable metal resin is preferable from 0.01 to 2.0 μm.

Another preferable intermediate layer is one composed of a binder resin and titanium oxide dispersed in the binder resin. The thickness of the intermediate layer employing the titanium oxide is preferable from 0.1 to 15 μm.

Preferable constitution of the photosensitive layer of the organic photoreceptor is described below.

Photosensitive Layer

The photosensitive layer of the photoreceptor is preferably constituted by a charge generation layer (CGL) and a charge transfer layer (CTL) each separated according to the functions thereof even though a single layer constitution having both of the charge generation and the charge transfer functions may be applied. The increasing of the remaining potential accompanied with repeating use can be inhibited and the electrophotographic properties can be easily controlled by employing the function separated layer constitution. For the photoreceptor to be negatively charged, it is preferable that the photoreceptor is constituted by the charge generation layer (CGL) provided on the subbing layer and the charge transfer layer (CTL) provided on the charge generation layer. For the photoreceptor to be positively charged, the layers are arranged in the order of the intermediate layer, CTL and CGL. The most preferable photoreceptor constitution is the negatively chargeable constitution having the foregoing function separated constitution.

The layer constitution of the negatively chargeable photoreceptor is described below.

<Charge Generation Layer>

The charge generation layer contains a charge generation substance and a binder resin, and is formed by coating a dispersion of the charge generation substance in the binder resin.

As the charge generation substance, known phthalocyanine compounds can be used. Preferable compounds are a titanylphthalocyanine compound and a hydroxygallium phthalocyanine compound. Y-type and A-type (β-type) phthalocyanine, and a phthalocyanine compound characterized by a principal peak of Bragg's angle 2θ of Cu—Kα characteristic X-ray with a wavelength of 1.54 Å are useful. Such the kinds of oxytitanylphthalocyanine are described in Japanese Patent Publication Open to Public Inspection No. 10-069107. These charge generation substances may be used solely or in a combination of two or more kinds of them such as a mixture of the A-type and B-type, or a combination with polycyclic quinine such as perylene.

As the binder resin of the charge generation layer, known resins may be used. Examples of the binder resin include polystyrene resin, polyethylene resin, polypropylene resin, acryl resin, methacryl resin, vinyl chloride resin, vinyl acetate resin, poly(vinyl butyral) resin, epoxy resin, polyurethane resin, phenol resin, phenol resin, polyester resin, alkyd resin, polycarbonate resin, silicone resin, melamine resin, a copolymer including two or more kinds of repeating unit of the above resins such as vinyl chloride-vinyl acetate copolymer and vinyl chloride-vinyl acetate-maleic anhydride copolymer, and polyvinylcarbazole. However, the usable resin is not limited to the above-described.

The charge generation layer preferable formed by the following procedure: A coating liquid is prepared by dispersing the charge generation substance in a solvent solution of the binder resin by a dispersing machine, and the coating liquid is coated as a layer having a uniform thickness by a coating apparatus, and then dried.

As the solvent to dissolve the binder resin to be used in the charge generation layer, the followings are cited: for example, toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrofuran, 1,4-dioxane, pyridine and diethylamine. However, the solvent is not limited to the above-described.

For dispersing the charge generation substance, an ultrasonic dispersing apparatus, a ball mill, a sand grinder and a homomixer are usable, but the dispersing means is not limited to them.

As the coating apparatus for coating the charge generation layer, an immersion coater and a ring coater are usable, but the coating means is not limited to them.

The mixing ratio of the charge generation substance to the binder resin is preferably from 1 to 600 parts, and more preferably from 50 to 500 parts, by weight to 100 parts by weight of the binder resin. The thickness of the charge generation layer is preferably from 0.01 to 5 μm, even though the thickness is varied depending on the property of the charge generation substance, that of the binder resin and the mixing ratio.

<Charge Transfer Layer>

The charge transfer layer contains a charge transfer substance and a binder resin, and is formed by coating a solution of charge transfer substance dissolved in a binder solution.

As the charge transfer substance, those represented by the formula disclosed in Japanese Patent Application No. 2000-360998, a carbazole derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline compound, an oxazolone derivative, a benzimidazole derivative, a quinazoline derivative, a benzofuran derivative, an acrydine derivative, a phenadine derivative, an aminostilbene derivative, a triarylamine derivative, a phenylenediamine derivative, a stilbene derivative, a benzidine derivative, poly-N-vinylcarbazole, poly-1-vinylpyrene and poly-9-vinylanthracene are usable, they may be used in combination of two or more kinds of them.

As the binder resin for the charge transfer layer, known resins can be used. Examples of the resin include polycarbonate resin, polyacrylate resin, polyester resin, polystyrene resin, styrene-acrylonitrile copolymer resin, polymethacrylate resin, and styrene-polymethacrylate resin. Polycarbonate resin is preferred. Polycarbonate resin such as BPA, BPZ, dimethyl BPZ and BPA-dimethyl BPA copolymer is preferred from the viewpoint of cracking resistivity, anti-frictional wearing and anti-static property.

The charge transfer layer preferable formed by the following procedure: A coating liquid is prepared by dissolving the charge transfer substance and the binder resin, and the coating liquid is coated as a layer having a uniform thickness by a coating apparatus, and then dried.

As the solvent for dissolving the binder resin and the charge transfer substance, for example, toluene, xylene, methylene chloride, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine and diethylamine are usable.

The mixing ratio of the charge transfer substance to the binder resin is preferably from 10 to 500 parts, and more preferably from 20 to 100 parts, by weight to 100 parts by weight of the binder resin. The thickness of the charge transfer layer is preferably from 10 to 100 μm, and more preferably from 15 to 40 μm, even though the thickness is varied depending on the property of the charge transfer substance, that of the binder resin and the mixing ratio.

An antioxidant (AO agent), an electron acceptable substance (EA agent) and a stabilizing agent may be added into the charge transfer layer. The AO agent described in Japanese Patent Application No. 11-200135, and the EA agent described in Japanese Patent O.P.I. Publication Nos. 50-137543 and 58-76483 are useful.

<Protective Layer>

A protective layer may be provided on the charge transfer layer to improve the durability. The protective layer employing a siloxane resin described in Japanese Patent O.P.I. Publication Nos. 9-190004, 10-095787 and 2000-171990 is preferred which improves the anti-wearing property. Although an example of the most preferable layer constitution in the invention is described in the above, another layer constitution may be applied in the invention.

The organic photoreceptor is described in the above, but it is not intended to exclude an inorganic photoreceptor, typically amorphous silicone, from the subject of the invention.

Next, the image forming apparatus employing the photoreceptor drum is described which is prepared by the manufacturing method according to the invention.

<Image Forming Apparatus>

Figure 12:
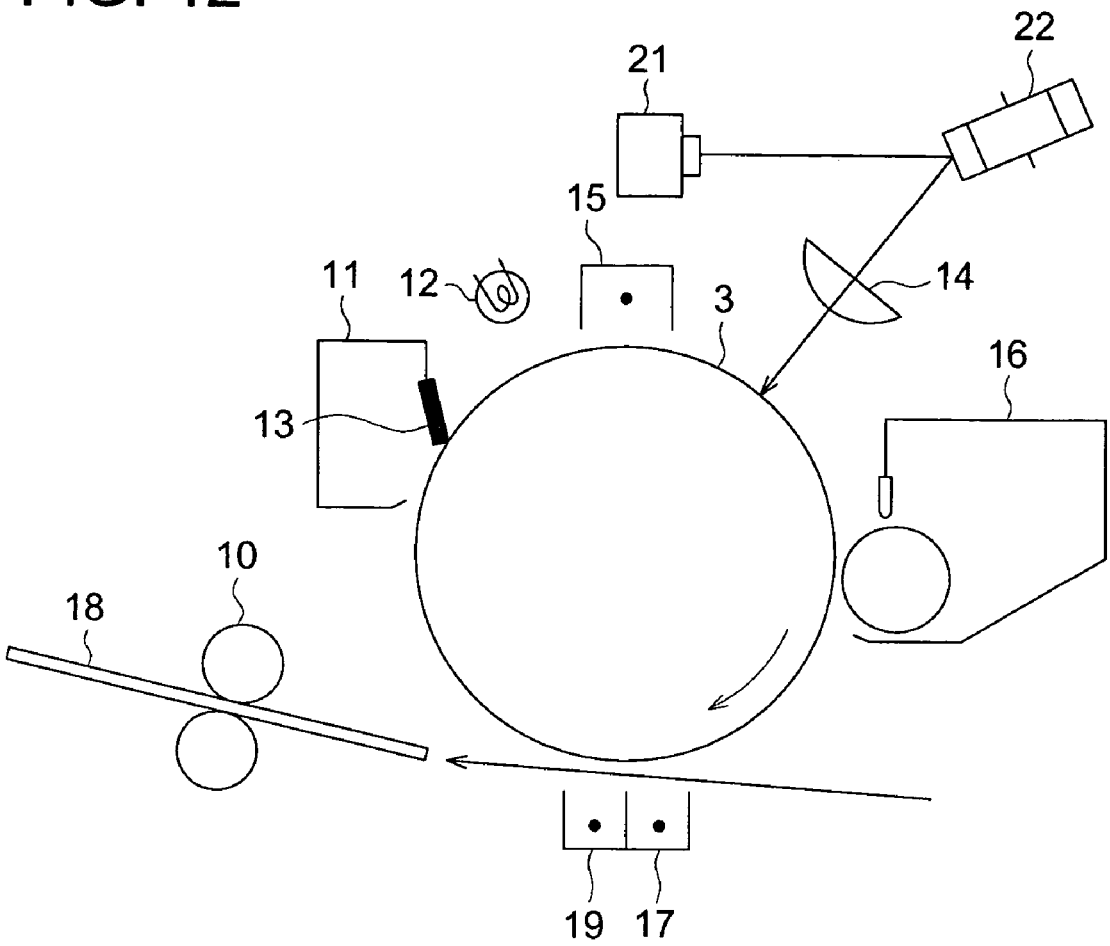
FIG. 12 is a cross section of an example of the image forming apparatus employing the photoreceptor drum.

FIG. 12 is cross section of an example of the electrophotographic image forming apparatus employing the photoreceptor.

The electrophotographic image forming apparatus is an apparatus to form an image employing the photoreceptor drum and repeating the processes for charging, light exposing, developing, transferring, separating and cleaning.

The electrophotographic image forming apparatus displayed in FIG. 12 is described below. A light beam is generated from a semi-conductor laser light source 21 according to the information read by an original reading device, not shown in the drawing. The photoreceptor drum 3 is scanned by the light beam through a scanning polygon mirror 22 and an fθ lens for compensating distortion of the image. Thus a static latent image is formed by a digital exposure system. The photoreceptor 3 is uniformly charged previously by a charging device and clockwise rotated synchronized with the timing of light irradiation.

The static latent image on the photoreceptor drum is subjected to reversal development by a developing device 16 to form a toner image. The toner image is transferred onto an image receiving material 18 by the action of a transfer device 17. The image receiving material is conveyed synchronized with timing. The image receiving material 18 is separated from the photoreceptor drum 3 by a separation device (separation electrode) 19. The toner image is carried by the image receiving material 18 and introduced into a fixing device 10 and fixed to form a printed image.

Thereafter, the not transferred toner remained on the photoreceptor drum 3 is removed by a cleaning blade type cleaning device 11, and the remained potential of the photoreceptor drum is removed by pre-light exposure device (PCL) 12. Then the photoreceptor 3 is uniformly charged by the charging device 15 for next image formation.

The typical image receiving material is paper, but the material is not specifically limited as long as the toner image before fixing can be transferred thereon; PET base for OHP use is usable as the image receiving material.

The cleaning blade 13 is usually made from rubber elastic material having a thickness of approximately from 1 to 30 mm; urethane rubber is frequently employed as the material of the blade.

Herein, the image forming apparatus in which the toner image is directly transferred from the photoreceptor to the image receiving material. However, an apparatus is not excluded, in which the toner image is once transferred onto an intermediate transferring medium and then transferred to the image receiving paper from the intermediate transferring medium. The image forming apparatus may be either an apparatus for forming a monochromatic image or that for forming a color image.

EXAMPLES

Examples employing the scouring tape according to the invention are described below, but the embodiment of the invention is not limited to the following examples.

1. Photoreceptor

Preparation of Photoreceptor 1

The following coating liquid was prepared and coated on an aluminum cylindrical support with a diameter of 30 mm manufactured by a pull out process to form a semi-electroconductive layer having a dried layer thickness of 15 μm.

| <Coating liquid of semi-electroconductive layer (PCL)> | |
|---|---|
| Phenol resin | 160 g |
| Electroconductive titanium oxide | 200 g |
| Methyl cellosolve | 100 ml |

Then the following intermediate layer coating liquid was prepared, and coated onto the semi-electroconductive layer by an immersion coating method to form an intermediate layer having a thickness of 1.0 μm.

| <Intermediate layer (UCL) coating liquid> | |
|---|---|
| Polyamide resin Amilan CM-8000 (Toray Co., Ltd.) | 60 g |
| Methanol | 1600 ml |
| Butanol | 400 ml |

The following liquid of the following composition was dispersed for 10 minutes by a sand mill to prepare a charge generation layer coating liquid. The coating liquid was coated by the immersion coating method onto the intermediate layer to form a charge generation layer having a thickness of 0.2 μm.

| <Charge generation layer (CGL) coating liquid> | |
|---|---|
| Y-type titanylphthalocyanine | 60 g |
| Silicone resin solution KR5240, 15% xylene-butanol solution (Shin' etsu Kagaku Co., Ltd.) | 700 g |
| 2-butanone | 2000 ml |

The following compositions were mixed and dissolved to prepare a charge transfer layer coating liquid. The coating liquid was coated by the immersion coating method onto the charge generation layer to form a charge transfer layer having a thickness of 20 μm. Thus Photoreceptor 1 was prepared.

| <Charge transfer layer (CTL) coating liquid> | |
|---|---|
| Charge transfer substance | 200 g |
| Bisphenol Z type polycarbonate Iupilon Z300 (Mitsubishi Gas Kagaku Co., Ltd.) | 300 g |
| 1,2-dichloroethane | 2000 ml |

Preparation of Photoreceptor 2

The following intermediate layer coating liquid was coated on a cylindrical aluminum drum with a diameter of 30 mm by the immersion coating method and dried at 150° C. for 30 minutes to form an intermediate layer having a thickness of 1.0 μm.

| <Intermediate layer (UCL) coating liquid> | |
|---|---|
| Zirconium chelate compound ZC-540 (Matsumoto Seiyaku Co., Ltd.) | 200 g |
| Silane coupling agent KBM-903 (Shin' etsu Kagaku Co., Ltd.) | 100 g |
| Methanol | 700 ml |
| Ethanol | 300 ml |

Then, the following coating composition was mixed and dispersed for 10 hours by a sand mill to prepare a charge generation layer coating liquid. The coating liquid was coated onto the intermediate layer by the immersion method to form a charge generation layer having a thickness of 0.2 μm.

| <Charge generation layer (CGL) coating liquid> | |
|---|---|
| Y-type titanylphthalocyanine | 60 g |
| Silicone resin solution KR5240, 15% xylene-butanol solution (Shin' etsu Kagaku Co., Ltd.) | 700 g |
| 2-butanone | 2000 ml |

Next, the following coating composition was mixed and dissolved to prepare a charge transfer layer coating liquid. The coating liquid was coated onto the charge generation layer by the immersion method to form a charge transfer layer having a thickness of 20 μm. Thus Photoreceptor 2 was prepared.

| <Charge transfer layer (CTL) coating liquid> | |
|---|---|
| Charge transfer substance | 200 g |
| Bisphenol Z type polycarbonate Iupilon Z300 (Mitsubishi Gas Kagaku Co., Ltd.) | 300 g |
| 1,2-dichloroethane | 2000 ml |

Preparation of Photoreceptor 3

The following coating composition was mixed and dissolved to prepare a protective layer coating liquid and coated onto Photoreceptor 2.

<Protective Layer (OCL) Coating Liquid>

Molecular Sieve 4A was added to 100 parts by weight of polysiloxane resin composed of 80 mole-% of methylsiloxane unit and 20 mole-% of methyl-phenylsiloxane unit and subjected to dehydration treatment after standing for 15 hours. The resin was dissolved in 10 parts by weight of toluene, and 5 parts by weight of methyltrimethoxysilane and 0.2 parts by weight of dibutyl tin acetate were added to the solution to prepare a uniform solution. To the solution, 6 parts by weight of dihydroxymethyltriphenylamine was added and mixed. Resulted solution was coated to form a protective layer having a thickness of 2 μm and thermally hardened at 120° C. for 1 hour. Thus Photoreceptor 3 was prepared.

Preparation of Photoreceptor 4

The following intermediate layer coating liquid was coated by the immersion coating method onto the cylindrical aluminum support with a diameter of 30 mm to form an intermediate layer having a dried thickness of 2 μm.

<Intermediate Layer (UCL) Coating Liquid>

A dispersion of the following composition was stood for one knight and then filtered by Ridimesh Filter, manufactured by Nihon Pall Co., Ltd., with a nominal precision of 5 μm, while applying a pressure of 5N/cm$^2$ to prepare an intermediate layer coating liquid.

| Dispersion for intermediate layer | |
|---|---|
| Polyamide resin CM8000 (Toray Co., Ltd.) | 1.0 parts by weight |
| Titanium oxide SMT500SAS (Teika Co., Ltd., the surface was subjected to a silica treatment and methylhydrogensiloxane treatmet by silica) | 3.0 parts by weight |
| Methanol | 20 parts by weight |

The following composition was dispersed by batch method for 10 hours employing a sand mixer to prepare a charge generation layer coating liquid. The coating liquid was coated by the immersion method to form a charge generation layer having a thickness of 0.3 μm onto the intermediate layer.

| <Charge generation layer (CGL) coating liquid> | |
|---|---|
| Y-type oxytitanylphthalocyanine showing a maximum peak of X-ray diffraction at a 2θ angle of 27.3° by Cu-Kα characteristic X-ray | 20 g |
| Poly(vinyl butyral) #6000C (Deniki Kagaku Kogyo Co., Ltd.) | 10 g |
| t-butyl acetate | 700 g |
| 4-methoxy-4-methyl-2-pentanone | 300 g |

The following composition was mixed and dissolved to prepare a charge transfer layer coating liquid. The coating liquid was coated on the charge generation layer by the immersion method to form a charge transfer layer having a layer thickness of 24 μm.

| <Charge transfer layer (CTL) coating liquid> | |
|---|---|
| Charge transfer substance | 75 g |
| Polycarbonate resin Iupilon Z300 (Mitsubishi Gas Kagaku Co., Ltd.) | 100 g |
| Dioxolane/toluene (mixing ratio in mole: 10/1) | 750 g |

2. Coated Layer Removing Method

A. <Method Employing the Tape>

Coated Layer Removing Method A-1

On the coated layer removing apparatus displayed in FIG. 7(*b*), the scouring tape and the photoreceptor drum were installed and the photoreceptor drum was rotated at a rate of from 5 to 30 rpm. Then the scouring tape impregnated with the solvent is contacted to the 10 mm width of the coated layer on the photoreceptor drum with a tilt angle of 1.0°. The tape was run at a speed of from 500 to 3,000 mm/min in the direction reverse to that of the rotation of the photoreceptor drum until the coated layer is removed. Thus coated layer was removed.

The scouring tape is contacted extending 15° on the periphery of the photoreceptor drum by two pressing rollers. A tension of 25N/20 mm width was applied between the let out roll and the take up roll.

Coated Layer Removing Method A-2

The method is the same as the method A-1 except that the tilt angle was not applied or 0.0.

B <Method Employing the Brush>

Coated Layer Removing Method B-1

The photosensitive layer is coated on the drum by the electrophotographic photoreceptor manufacturing apparatus shown in FIG. 8 so that about 1 cm width of non-coated area was made at the upper end of the support; and then the photoreceptor drum was move to the coated layer removing process. In the coated layer removing process, the series of operation described in FIG. 8 was performed to remove 1 cm width of the coated layer. After that, the drum was moved to the drying process to prepare the photoreceptor. The solvent charged in the solvent tank of the coated layer removing apparatus was methylene chloride the same as the solvent of the charge transfer layer. The scouring member of the coated layer removing stand was a rotating 0.5 mm polyester brush. The remaining solvent amount in the edge portion of the coated layer at the time of the start of coated layer removing was 12.0% by weight when the solvent amount of the coating liquid was defined as 100% by weight.

Coated Layer Removing Method B-2

The polyester brush the same as that used in the removing method B-1, but the coated layer removing stand was immersed in the solvent tank such as described in Example 1 of Japanese Patent O.P.I. Publication No. 5-142789 to remove the lower end portion of the coated layer.

The coated layer removing was performed by each of the combinations of the above-described Photoreceptors 1 through 4 and the removing methods A-1 through B-2 as shown in Table 1.

Results are listed in Table 1.

The photoreceptors, the edge portion of each of which was removed by the examples 1 through 7, or examples 8 through 10, were each installed in a copying machine U-BIX 4145, manufactured by Konica Corp., modified so that the exposure system is changed to a digital image exposing system employing a semi-conductor laser (780 nm) as the light source, and 10,000 times of image formation test was performed. And then the image quality, particularly the unevenness of the image density near the edge portion, peeling of the coated layer, defects of the coated layer caused by scatter of the powdered coated layer, situation of the black spots occurrence and the toner contamination were observed.

3. Method and Norm for Evaluation

Unevenness of image density at the edge portion: Judged by the density difference of the halftone image (ΔHD=The maximum density at the position 1 cm far from the edge—Density at the central portion).

A . . . Not more than 0.05; Good

B . . . Larger than 0.05 and less than 0.1

C . . . Not less than 0.1

Black Spot

A . . . Frequency of black spot of not less than 0.4 mm: The entire copy images each have not more than 3 spots per A4 size copy.

B . . . Frequency of black spot of not less than 0.4 mm: One or more A4 size copies each having from 4 to 19 spots were found.

C . . . Frequency of black spot of not less than 0.4 mm: One or more A4 size copies each having not less than 20 spots were found.

Peeling of Coated Layer

A . . . Not occur.

B . . . A little peeling was found at the edge portion, but the peeled are is not encroached into the image area.

C . . . The peeled area was encroached into the image area; not acceptable.

TABLE 1

| Example | Photoreceptor No. | Removing method | Employed solvent | Irregularity in the peripheral direction (μm) | P (μm) | $P_{max} - P$ (μm) | $(P_{max}/D) \times 100$ | Removed situation at the edge portion |
|---|---|---|---|---|---|---|---|---|
| Example 1 | 1 | A-1 | Methanol/methylene chloride = 1/1 | <2 | 20 | 7 | 3 | Good |
| Example 2 | 2 | A-1 | Methanol/methylene = 1/1 | <2 | 15 | 8 | 20 | Good |
| Example 3 | 3 | A-1 | Methanol/methylene = 1/1 | <2 | 30 | 20 | 10 | Good |
| Example 4 | 4 | A-1 | Methanol/Dioxolane = 1/1 | <2 | 25 | 21 | 5 | Good |
| Example 5 | 1 | B-1 | Methanol/methylene = 1/1 | <2 | 22 | 18 | 40 | Good |
| Example 6 | 3 | B-1 | Methanol/methylene = 1/1 | <2 | 26 | 19 | 10 | Good |
| Example 7 | 4 | B-1 | Methanol/Dioxolane = 1/1 | <2 | 20 | 3 | 3 | Good |
| Example 8 | 2 | A-2 | Methanol/Dioxolane = 1/1 | to 4 | 16 | 20 | 20 | Projection of the edge is large and easily come off. |
| Example 9 | 3 | A-2 | Methanol/Dioxolane = 1/1 | to 4 | 26 | 8 | 1 | The thin portion of the edge is overlapped with the image area. |
| Example 10 | 3 | B-2 | Methanol/Dioxolane = 1/1 | to 4 | 26 | 12 | 55 | Burrs rise and are easily peeled. |

*Irregularity in the peripheral direction: Different of the largest value and the smallest value of the irregular edge in the removing direction when the drum is looked down.

TABLE 2

| Example | Unevenness of image density at the edge portion | Black spot | Peeling of coated layer |
|---|---|---|---|
| Example 1 | A | A | A |
| Example 2 | A | A | A |
| Example 3 | A | A | A |
| Example 4 | A | A | A |
| Example 5 | A | A | A |
| Example 6 | A | A | A |
| Example 7 | A | A | A |
| Example 8 | C | C | C |
| Example 9 | C | B | B |
| Example 10 | C | C | C |

It is under stood from Table 2 that each of Examples 1 through 7 shows good properties but each of Examples 8 through 10 shows inferior result on at least one of the properties.

As shown in the example, the embodiments of the invention can perform following results: the toner is not accumulated at the edge portion since the edge of the coated layer is smooth; the contamination by the toner does not occur, the adhesiveness of the edge portion of the coated layer is high, any image defect does not occur, the durability of the photoreceptor is superior, the coated layer is not peeled from the edge portion depending on the shape of the edge of the coated layer, and the defect such as the black spot caused by scattering of the powdered coated layer of the toner does not occur.

What is claimed is:

1. An electrophotographic photoreceptor comprising a layer on a support, wherein the photoreceptor satisfies a condition represented by Formulas (1) and (2)

$$P<P_{max}<2P \quad \text{Formula (1)}$$

$$2\leqq(P_{max}/D)\times100\leqq50 \quad \text{Formula (2)}$$

wherein P represents an average of the thickness (μm) of the layer at the central portion of the support in the width direction of the image formation and P is from 15 to 35 μm, $P_{max}$ represents an average of the maximum value of the layer thickness (μm) at the area without the image formation area, and D represents an average distance (μm) from the edge of the layer to the point where the maximum value is formed.

2. The photoreceptor of claim 1, wherein the support is an endless belt.

3. The photoreceptor of claim 1, wherein the photoreceptor has cylindrical shape.

4. The photoreceptor of claim 3, further comprising a photosensitive layer and an intermediate layer between the support and the photosensitive layer.

5. The photoreceptor of claim 1, further comprising a photosensitive layer and an intermediate layer between the support and the photosensitive layer.

6. A method for manufacturing an electrophotographic photoreceptor as defined in claim 1 comprising:

forming the layer on the support, and removing the edge portion of the layer by a scouring member.

7. The method of claim 6, wherein the scouring member comprises a brush.

8. The method of claim 7, wherein the forming step is carried out by coating with a coating liquid having a solvent therein and the removing step is started when the amount of solvent remaining is from 3 to 60% by weight.

9. The method of claim 6, wherein the scouring member comprises a tape.

10. The method of claim 9, wherein the tape is contacted to the layer on the support and run to remove the layer and the running direction of the tape is tilted to the face perpendicular to the length direction of the support (the cross direction to the image formation) with an angle θ of more than 0° and less than 40°.

11. The method of claim 10, wherein the tape can be impregnated by a solvent.

12. The method of claim 11, wherein the running direction of the tape is reverse to the direction of the rotation of the photoreceptor.

13. A method for forming an image comprising:

forming a toner image by developing a latent image formed on the photoreceptor described in claim 1, transferring the toner image onto a recording medium, and removing the toner remained on the photoreceptor.

* * * * *